United States Patent [19]

Huang

[11] Patent Number: 4,773,092

[45] Date of Patent: Sep. 20, 1988

[54] SPEECH SCRAMBLERS

[75] Inventor: Frederick Huang, Oxford, England

[73] Assignee: Racal Research limited, Berkshire, England

[21] Appl. No.: 923,035

[22] Filed: Oct. 24, 1986

[30] Foreign Application Priority Data

Oct. 25, 1985 [GB] United Kingdom ..... 8526409

[51] Int. Cl.[4] ..... H04K 1/04

[52] U.S. Cl. ..... 380/9; 380/36; 380/38; 380/48

[58] Field of Search ..... 380/36, 38, 9, 48

[56] References Cited

U.S. PATENT DOCUMENTS

| | | | |
|---|---|---|---|
| 4,100,374 | 7/1978 | Jayant et al. | 380/36 |
| 4,149,035 | 4/1979 | Frutiger | 380/36 |
| 4,221,931 | 9/1980 | Seiler | 380/36 |
| 4,295,223 | 10/1981 | Shutterly | 380/38 |
| 4,305,152 | 12/1981 | Asakawa et al. | 380/48 |
| 4,365,110 | 12/1982 | Lee et al. | 380/48 |
| 4,433,211 | 2/1984 | McCalmont et al. | 380/38 |
| 4,525,844 | 6/1985 | Schenermann | 380/36 |
| 4,551,580 | 11/1985 | Cox et al. | 380/38 |
| 4,591,673 | 5/1986 | Lee et al. | 380/48 |

FOREIGN PATENT DOCUMENTS

| | | |
|---|---|---|
| 6055750 | 7/1985 | Japan . |
| 8304460 | 12/1983 | PCT Int'l Appl. . |
| 1157870 | 7/1969 | United Kingdom . |

OTHER PUBLICATIONS

IEEE Communications Magazine, vol. 23 (1985) Jul. "A Speech Security System Not Requiring Synchronization" (Lin shan Lee).

Brown Boverie Mit vol. 61, No. 6 (1974) Jun. "Das Sprachverschlüsselungsgerät Cryptophon 1100" (Vouga et al.).

"Baseband LPC Coders for Speech Transmission over 9.6 kb/s Noisy Channels" by R. Viswanathan et al. IEEE, 1980, pp. 348–351.

"Analog Voice Privacy with a Microprocessor", by Sergei Udalov, 5/14–5/16/80, 1980 Carnahan Conference on Crime Counteramesures.

*Primary Examiner*—Salvatore Cangialosi

*Attorney, Agent, or Firm*—Leydig, Voit & Mayer

[57] ABSTRACT

A band scrambler which processes only time domain samples is described. The band scrambler has the effect of dividing the input signal spectrum into N sub-bands. The N sub-bands are permuted such that the r th band is mapped onto the k.r th band modulo N, where N is a constant of the scrambler and k is the key which is variable in the range $2<k<N-1$. The output samples y(n) produced by the scrambler from the input speech signal samples x(n) are defined by the equation:

$$y(n) = \sum_{n'=1}^{2LN} x(n-n')\, h(n')\, s(n'+n(k-1)) \qquad (1)$$

The down-sampling function $s(n'+n(k-1))$ determines which of N series of ganged switches is closed and the window function h(n') determines the values of the factors stored in the multipliers. The summation is carried out by the adder in order to produce the required output time samples which are reconverted to an analogue signal via a digital-to-analogue converter. The signal can be de-scrambled by sampling and passing through another identical scrambler operating with a key, k*, where $kk^*=1$ (mod N).

9 Claims, 5 Drawing Sheets

SPEECH SCRAMBLERS

BACKGROUND OF THE INVENTION

1. Technical Field

The present invention relates to speech scramblers.

A speech scrambler is used to scramble an input speech signal so that it can be securely sent along a telephone line. It is necessary that the signal sent along the telephone line be an analogue signal of the same bandwidth as a normal speech signal but that it be unintelligible to anybody tapping onto the line. However, the speech should be intelligible to the other party to the conversation who is equipped with a compatible de-scrambler.

2. Prior Art

Various types of speech scrambling systems are known. For example, many systems use digital processing by sampling the input speech signal at fixed time intervals to produce a block of time samples. In one system the blocks of time samples are simply rearranged and converted back into an analogue signal for transmission. Such a system is a time domain scrambler. This system requires synchronisation between the transmitting scrambler and the receiving de-scrambler in order to achieve an acceptable speech quality at the output of the de-scrambler.

In a typical frequency-domain scrambler, the block of time samples is converted by a fast Fourier transform to produce a series of Fourier coefficients representing the frequency spectrum of the input speech signal. If these Fourier coefficients are permuted before being subjected to an inverse fast Fourier transform, a new block of time samples is produced which can be converted into a scrambled analogue signal for transmission. At the receiver the input signal is again sampled and these samples subjected to a fast Fourier transform. The resulting coefficients are permuted in the inverse manner to the permutation applied by the scrambler and subjected to a Fourier transform and this produces a sequence of time samples which should convert to the original input speech signal.

Such systems have certain disadvantages. In particular the output signal may well contain unwanted high frequency components. These are produced as a result of the block processing of the input speech signal which means that there may be waveform discontinuities at the "joins" between the blocks output by the scrambler. Various windowing techniques have been employed to attempt to overcome these defects.

Such a basic frequency-domain scrambler also requires synchronisation between the scrambling systems employed at each end of the link. This has been overcome in recent designs by the use of short time Fourier transforms (STFT). Such a scrambling system is described by L. S. Lee et al in a paper entitled "A new frequency-domain speech scrambling system which does not require frame synchronisation" in IEEE Trans., Com-32, No. 4, April 1984.

The latter system may basically be regarded as continuously passing the input signal through a bank of frequency shifters, the output of each frequency shifter being passed to an ideal low pass filter. The outputs of the filters are then permuted. The scrambled frequency spectrum is then reconverted into an analogue signal for transmission.

The requirement in such a system to carry out the necessary windowing of both the input signal and the scrambled output, together with the intermediate STFT processing of the samples, imposes a considerable requirement for processing power. This makes such systems very expensive.

Another system which operates on time-domain samples is described in a paper entitled "An efficient time-domain sample value scrambling scheme eliminating frame synchronisation requirement for secure speech communications" by G. L. Chou and L. S. Lee in Global Telecommunications Conference, December 1982. This system does not require synchronisation, but still requires both the input and scrambled output to be windowed besides the intermediate permutation operation and, therefore, still requires considerable processing power.

SUMMARY OF THE INVENTION

An object of the present invention is to provide a scrambler which requires no synchronisation but is capable of providing a high degree of security and intelligibility with a relatively simple processing strategy which requires only a single windowing process.

The present invention accordingly provides a speech scrambler, comprising means for producing a first series of time samples by sampling an input speech signal at regularly spaced time intervals, means for deriving from said first series a new series of time samples, including means for selecting in accordance with a down-sampling function some of the samples of the first series produced in a preceding time period and means for effectively multiplying the selected samples by predetermined factors and summing the products to produce each new sample, and means for converting said new series of samples into a scrambled analogue signal by considering them as time samples of said scrambled signal.

Such a scrambler may be used in conjunction with a de-scrambler constructed as the scrambler defined above operating on said scrambled analogue signal instead of an input speech signal, and in which the selecting means uses a down-sampling function which has the inverse effect to the down-sampling function used by the scrambler.

Such a system does not require synchronisation between the scrambler and de-scrambler while the same down-sampling function and its inverse are in use. If the down-sampling function varies with time then the inverse function used by the de-scrambler must vary in synchronisation. Such a synchronisation requirement can, however, be far less rigorous than systems which require the individual time samples to be accurately synchronised.

The system is moreover simple to implement since only a small number of multiplications and an addition are required to derive each new time sample. This represents a considerable processing saving over the prior art systems without sacrificing speech quality whilst maintaining reasonably good security.

DESCRIPTION OF PREFERRED EMBODIMENTS

Figure 1:
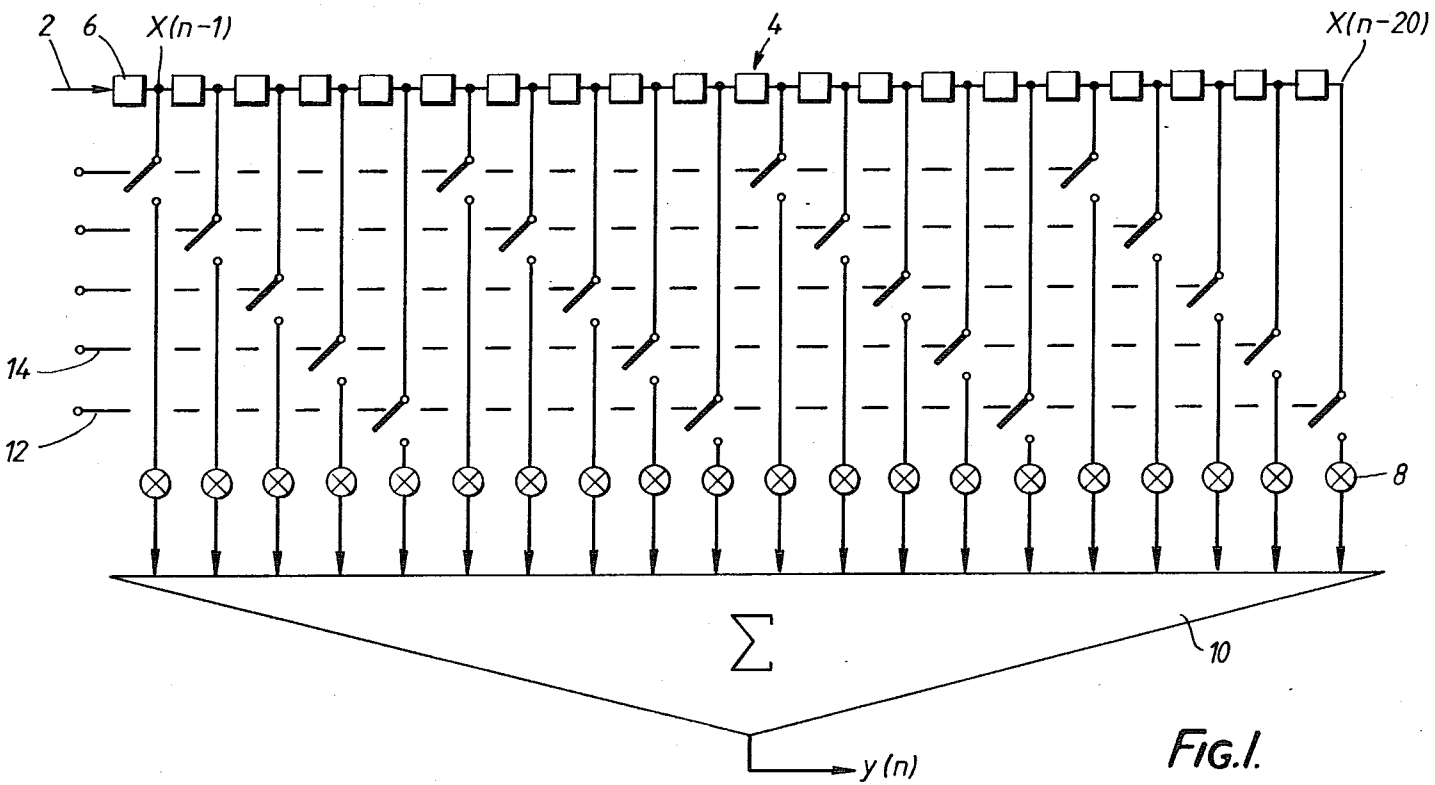
FIG. 1 is a block diagram of the speech scrambler.

Although the scrambler to be described processes only time-domain samples, it nevertheless functions as a band scrambler in the frequency-domain. That is, it takes an input speech signal and filters the signal into a series of sub-bands. The filter outputs are scrambled by shifting their centre frequencies, and the resulting spectrum produced is that of a scrambled signal for transmission over the telephone line.

The present scrambler utilizes a particular method of permuting the sub-bands which is found to produce a surprisingly advantageous reduction in the processing requirement of the system. The permutations permitted in the described system may be defined in the frequency-domain as shifting the r th sub-band to the position of the sub-band indexed as kr (modulo N) where k is the key of the scrambler and N is a constant, typically of the order of 200. it is necessary that k and N be coprime and therefore it is preferred that N be selected as a prime number allowing all integer values of k in the range $2 \leqq k \leqq N-1$ to be used.

With the permutation of the sub-bands limited in this way the speech scrambler can be completely defined in the time-domain by the following equation:

$$y(n) = \sum_{n'=1}^{2LN} x(n-n')\, h(n')\, s(n'+n(k-1)) \tag{1}$$

In the above equation x(n) represent a series of time samples of the input speech signal taken at times defined by $n = \ldots, -1, 0, 1, 2 \ldots$, where n is a normalised time index. The time interval between the samples may be of the order of 125 microseconds or less. The sampling is selected to be at the Nyquist rate for the speech bandwidth required.

h(n') is a windowing function. A suitable windowing function is as follows:

$$\begin{aligned} h(n) &= w(n)\,\mathrm{sinc}\left[\pi\frac{(n-NL)}{N}\right] 0 < n \leqq 2NL \\ &= 0 \text{ otherwise} \end{aligned} \tag{2}$$

where sinc (x)=sin (x)/x and w(n) is an additional window which has the effect of smoothing the ripples in the frequency response of sinc $[\pi(n-NL)/N]$.

N and L are constants of the scrambling system and N is typically chosen to be a prime number in the region of 200 and L an integer, for example, 2. N defines the number of sub-bands into which the frequency spectrum of the input speech signal is divided when the effect of the scrambler in the frequency-domain is considered.

The function s(n) is a down-sampling function which is defined as:

$$\begin{aligned} s(n) &= 1 \qquad n = \ldots -N, 0, N, 2N \ldots \\ &= 0 \text{ otherwise} \end{aligned} \tag{3}$$

The range of the summation in equation (1) is limited to 2LN since the function h(n) is 0 outside that range. It will be noted that the down-sampling function has only 2L non zero values within the summation range. Therefore, each value of y(n) is the sum of only 2L terms each requiring one multiplication.

The y(n) are then the time samples of the scrambled signal which can be converted back to a scrambled speech signal by means of a digital-to-analogue converter for output from the scrambler onto the telephone line. Thus, the scrambler defined by equation (1) acts as a time-varying transversal filter, the coefficients of which are highly down-sampled versions of h(n).

FIG. 1 illustrates a block diagram of the scrambler for producing the required y(n). For simplicity of illustration N has been chosen to be 5 in this Example rather than a more typical value of 199. The input speech signal to be scrambled is fed via an analogue-to-digital converter which samples it at the Nyquist rate. As the samples are produced they are fed via an input 2 to a delay line 4 which is made up of a series of time delay blocks 6 which each produce a delay equivalent to the sampling interval. Therefore, the delay line is capable of storing 2LN samples, in this case 20. At time n the sample available downstream of the first delay block 6 on the delay line is x(n−1). The sample available at the end of the delay line is x(n−20). Each intermediate point of the delay line is connected via a switch to a respective multiplier 8. Each of the multipliers 8 contains a predetermined constant factor. These factors are determined by the window function h(n') where n' is the number of time delay blocks 6 between the input 2 and the connection to the respective multiplier. The switches connected to the delay line are ganged together in N series where each of the switches of each series is separated by N delay line blocks 6. At each time n a particular series of ganged switches is closed. The particular series of switches to be closed depends on the value of the down-sampling function s(n'+n(k−1)). This function is 1 when n'+n(k−1)=0 or an integer multiple of N. At a time n=0, the down-sampling function is 0 except for those values where n'=−2LN, . . . −2N, −N. In the present example the ganged series of switches 12 is closed at time n=0.

At time n=1 the values of n for which the down-sampling function is non-zero are n=−2NL+k . . . −2N+k, −N+k. In the present example k may be 2, 3 or 4. Suppose k=2, then for n=1 values of n' for which the down-sampling function is non-zero are 19, 14, 9 and 4. This means that the series of switches 14 are closed. Of course, at each successive sampling interval, the values of the x(n) available at each point on the delay line move along one. The y(n) are obtained by summing the outputs of the multipliers 8 to which the input switches are closed in an adder 10. The y(n) are fed sequentially to a digital-to-analogue converter the output of which is fed along a telephone line. The whole sequence of y(n) will use all values of x(n) but not in their original order. The order in which they are used depends upon the key k, which determines the sequence in which the N series of ganged switches are closed. If the series of switches are labelled m, where m runs from 0 to N−1, and in the illustrated example m=0 for series of switches 12 and m=1 for series 14, the mth series of switches is closed at time n where m=n(k−1) mod N.

It will be appreciated that various methods of implementation can be used for evaluating the y(n). For example, the delay line may be a series of memory locations in which the required 2LN samples are stored. It is not essential that the individual samples be moved from location to location provided their order is maintained. The illustration of a delay line in FIG. 1 has merely been used to simplify the explanation of the operation of the device and explain the steps which are effectively required. The manner in which this scrambling system can be implemented by programming a microprocessor will be readily appreciated by a skilled programmer. However, whatever method of implementation is used, it is only necessary effectively to carry out 2L multiplications and an addition to derive each y(n).

Since the signals x(n) and y(n) have a wide dynamic range, it is desirable to provide a large number of bits for their storage, for example 12. The values of the windowing function h(n) (as stored in the multipliers 8) may be expressed to fewer bits, for example 4, since the exact form of this function has not been found to be critical.

In a practical embodiment of the invention, a logarithmic analogue-to-digital converter may be provided for producing the samples x(n). The multipliers 8 are then replaced by adders in which the logarithmic value of the window function is stored. The outputs from these adders are then converted to analogue form using an anti-logarithmic digital to analogue converter, and the adder 10 implemented by analogue means.

The de-scrambler for use with the scrambler of FIG. 1 is identical in form to the scrambler except that it utilizes a different key k*. The de-scrambling key k* is defined such that $$k.k^* \pmod N = 1 \tag{4}$$

For the de-scrambler the input signal y(n) is sampled and fed to the input 2 of the delay line. The outputs from the adder 10 are then the de-scrambled samples. As with prior art band scramblers it is found that synchronisation between the sampling of the scrambler and de-scrambler is not necessary. Any misalignment between the sampling of the signals introduces a phase error which varies with frequency. As the human ear is relatively insensitive to phase errors, the absence of synchronisation does not adversely affect the speech.

The value of k* for de-scrambling can be calculated from equation (4) in a known manner or obtained by a trial and error process. The required values may be stored in a look-up table within the de-scrambler.

In order to appreciate the effect the described scrambler has on an input speech signal, reference will be made to FIG. 2.

The down-sampling function (3) can be expressed as follows:

$$s(n' + n(k-1)) = \frac{1}{N}\sum_{r=0}^{N-1} \exp\left\{\frac{2\pi}{N} j[(k-1)n + n']r\right\} \tag{5}$$

Using equation (5), equation (1) becomes $$y(n) = \sum_{r=0}^{N-1}\sum_{n'=1}^{2LN} x(n-n')\exp\left\{\frac{2\pi}{N} j(kr - r)(n-n')\right\}\frac{1}{N} h(n')\exp\left\{\frac{2\pi}{N} jrkn'\right\} \tag{6}$$

This can be seen to be a convolution of the sequences $$x(n)\exp\left[\frac{2\pi}{N} j(k-1)rn\right] \text{and } \frac{1}{N} h(n)\exp\left\{\frac{2\pi}{N} jkrn\right\},$$

summed over r.

Since the windowing function h(n), the input speech sequence x(n) and the output y(n) are discrete samples, with time normalised so that the samples occur at times n=0, 1, 2 etc., the Fourier transforms of these signals, represented as H(f), X(f) and Y(f) in the following analysis, are periodic with period 1. In the interval $-\frac{1}{2}<f<\frac{1}{2}$, X(f) and Y(f) are also equal to the transforms of the corresponding analogue signals assuming that the sampling is at the Nyquist rate.

The Fourier transform of equation (6) becomes:

$$Y(f) = \sum_{r=0}^{N-1} \frac{1}{N} H\left(f - \frac{kr}{N}\right) X\left(f - \frac{(kr-r)}{N}\right) \tag{7}$$

This equation is the frequency-domain equivalent of equation 1 and completely describes the basic scrambler.

The properties of this equation are illustrated in FIG. 2. In the example of FIG. 2, the values N=17, k=3 and r=2 have been chosen. FIG. 2A illustrates a diagrammatic Fourier transform of an input speech signal. The form of this spectrum represents a spectrum of a typical speech signal, time-averaged over a period of at least 500 ms, and with frequency subsequently normalised to the range $\frac{1}{2}\leqq f\leqq\frac{1}{2}$. The spectrum X(f) is forced to be hermitian [X(f)=X*(−f)] and periodic with period 1 since the x(n) are real.

Figure 2A:
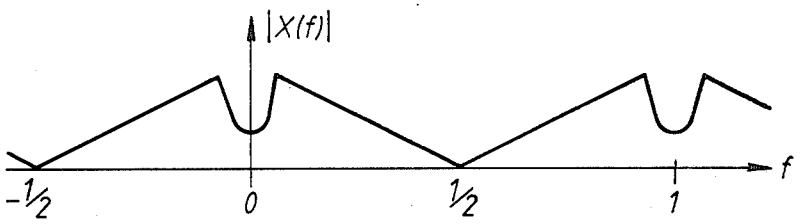
FIGS. 2A to D illustrate the effect of the scrambler in the frequency domain.
Figure 2B:
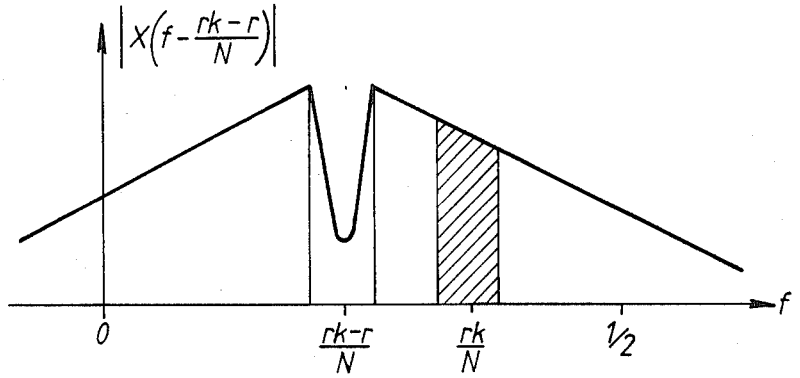
Figure 2C:
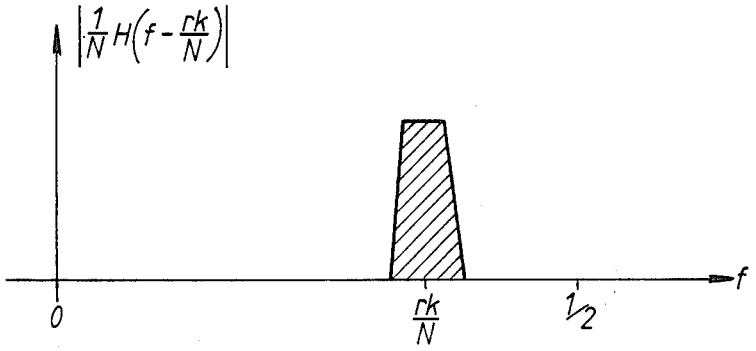

For any single value of r in the summation of equation (7) above, X(f−(kr−r)/N) is the input spectrum shifted by (kr−r)/N, as illustrated in FIG. 2B. With the selected values of r, k and N the frequency shift is 4/17. H(f) as illustrated in FIG. 2C is an approximation of a rectangular filter with bandwidth 1/N. Thus the filter H(f−kr/N) passes only a sub-band of frequency centered on f=rk/N. This sub-band corresponds to a sub-band near f=r/N in the original input spectrum X(f). The sub-band r/N in the input is shifted to the sub-band k(r/N) in the output spectrum Y(f). As H(f) and X(f) are periodic, (kr)/N can be interpreted as {(kr) mod N}/N.

Figure 2D:
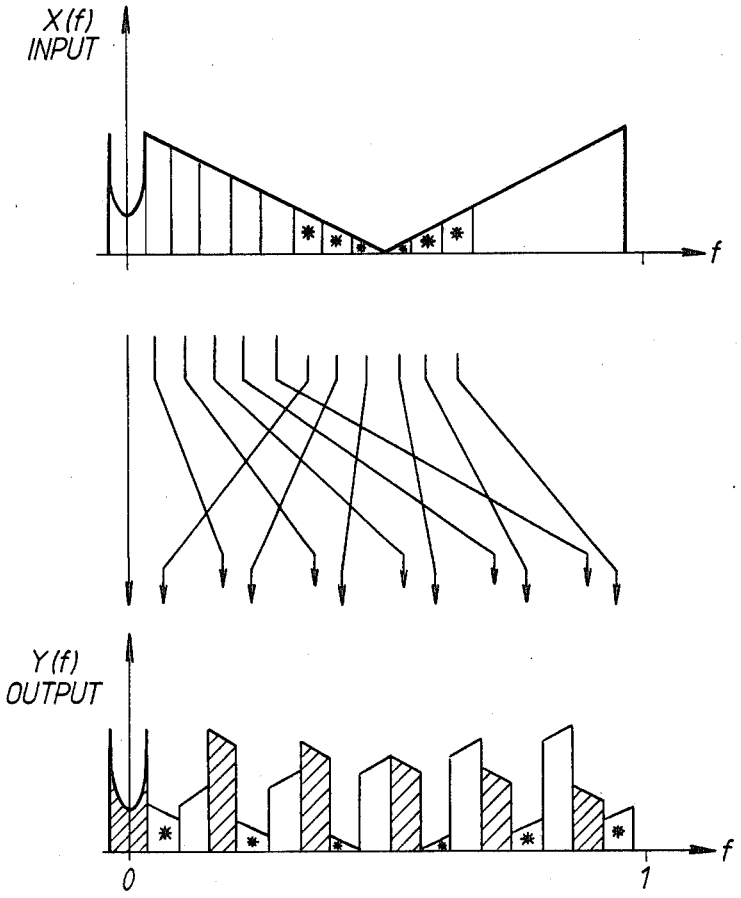

FIG. 2D illustrates how the frequency bands of the original input spectrum X(f) are mapped onto the output spectrum Y(f). This diagram is produced by taking all values of r in the summation of equation (7) above. The effect of this is that the sub-bands centered at frequencies f=0, 1/N, . . . (N−1)/N have been scrambled so that if each sub-band is labelled as r=0, 1 . . . N−1 respectively the scrambling operation can be described as follows:

$$rkr \pmod N \tag{8}$$

If X(f) is hermitian [X(f)=X*(−f)] it can be verified that Y(f) is also hermitian, so y(n) is real, as expected.

Given the restriction on the possible permutations to the type referred to in equation (8) above, this band scrambler enables particularly simple implementation to be used. The key k has to be in the range $2 \leqq k \leqq N-1$ since $k=1$ corresponds to no scrambling and a key of $k+N$ has the same effect as k. The requirement already set out that k and N should be coprime is to ensure that no two sub-bands in the input speech spectrum are mapped onto the same sub-band in the output spectrum.

Figure 3:
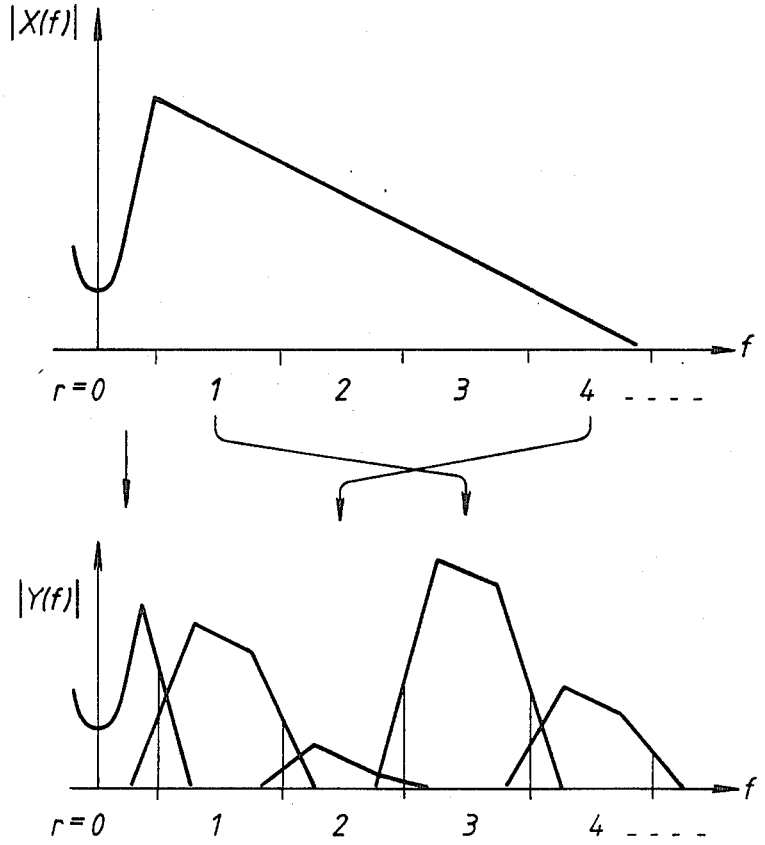
FIG. 3 is a diagram illustrating the effects of an imperfect separation of the frequency bands by the described scrambler.

In a practical embodiment of the scrambler the transform H(f) of the windowing function h(n) will not have the precisely rectangular form illustrated in FIG. 2. The effect of variations in the shape of H(f) on the efficiency of the scrambler are illustrated in FIG. 3. In a normal speech signal the power is concentrated at low frequency. However, despite the smaller power, the higher frequencies represent important information, partly because the human ear is more sensitive to them. In a practical realisation of the scrambler, the window function will not be ideal and this effectively means that the sub-bands will extend beyond their allotted bandwidth. Thus, if a high frequency sub-band is mapped in between two lower frequency sub-bands as illustrated in FIG. 3 the amount of energy in this band may be modified by the relatively large leakage from the adjacent bands. The upper plot in FIG. 3 shows the idealised frequency spectrum of a speech signal averaged over a long period of time. In this case the high frequency band $r=4$ is mapped in the output spectrum Y(f) to the position $r=2$. This is between two lower frequency sub-bands from the original input spectrum. Since these bands have much greater energy, the leakage into the band $r=2$ in the output spectrum is considerable. After de-scrambling, the output power and the recovered speech signal will be distorted by the excess energy at these higher frequencies. Provision of a pre-emphasis filter prior to sampling augments the higher frequencies. The output of the de-scrambler is restored to the original spectrum by a de-emphasis filter following its output. Another advantage of the inclusion of the pre-emphasis and de-emphasis filters is to reduce the risk of the key being decoded by a listener who can, over a period of time, estimate the original positions of the sub-bands by their power levels. Thus, a sub-band which is consistently of higher average power level would normally be a sub-band of low frequency. However, the presence of the pre-emphasis filter reduces this consistent variation in the power of the sub-bands and thus reduces the risk of this type of crypt-analysis.

Figure 4:
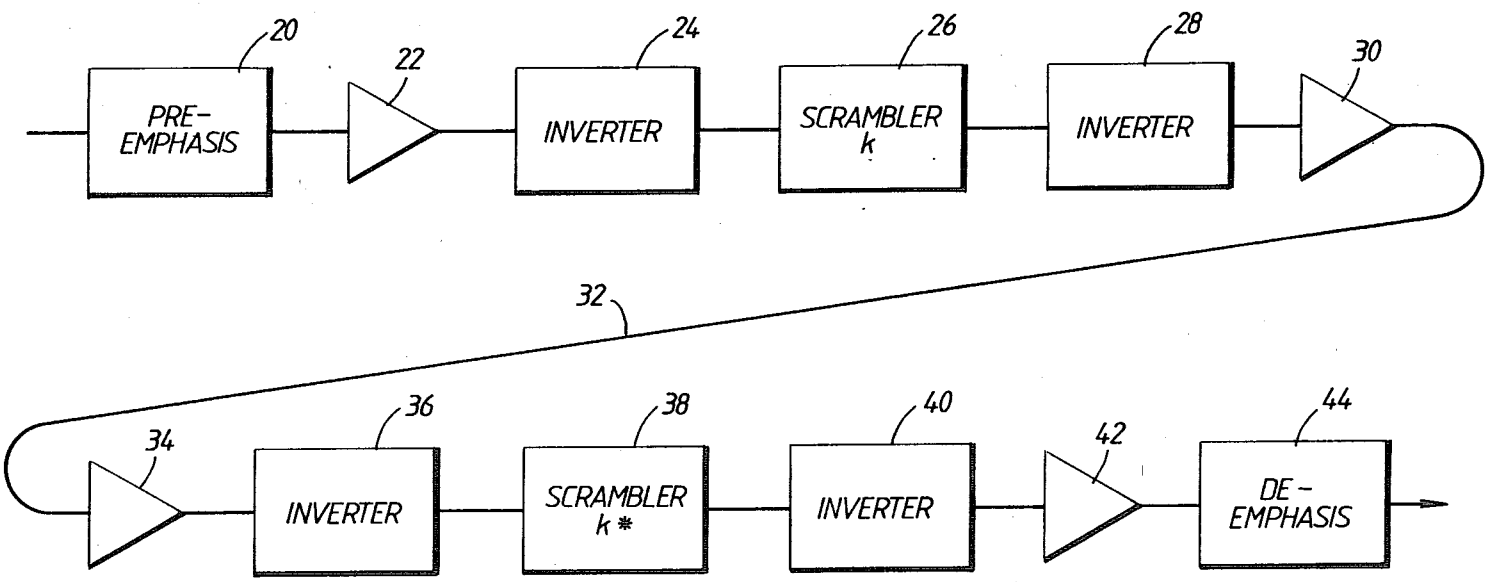
FIG. 4 is a block diagram of a practical embodiment of a communications system using the scrambler of FIG. 1.

A practical embodiment of a communications system for passing a scrambled signal along a telephone line will now be described with referece to FIG. 4.

An input speech signal is fed via a pre-emphasis filter 20 to an analogue-to-digital converter 22 (including an anti-aliasing filter) which may, as previously discussed, be a logarithmic converter. The converter 22 may be made operable at different sampling rates to further increase possible system codes. For example, five sampling rates selected between 6.5 and 8 KHz may be selectively chosen. The output of the converter 22 is fed to a frequency inverter 24 which multiplies the digitised speech signal by $(-1)^n$ which has the effect of shifting the frequency spectrum by half the sampling frequency. This shifts the frequency spectrum illustrated in FIG. 2A by half a period (i.e. by $f=\frac{1}{2}$). Since the low frequency component of the output signal after inversion originated from the high frequency component of the original input signal, the process is described as frequency inversion. It can be verified that this particular frequency shift results in the Fourier transform of the shifted input signal being hermitian provided the Fourier transform of the unshifted signal is hermitian. Thus the output from the inverter is real as expected. The inverter 24 is selectively controllable so that the number of codes available to the system can be increased since for each key k of the following scrambler 26, inversion can either be selected or not selected. This provides a number of codes for the system which is twice the number of keys. This enlarged number of codes can be shown to be distinct where N is a prime number.

The output of the inverter 24 is fed to the scrambler 26 with key k. The scrambler 26 is as described with reference to FIG. 1. The y(n) output from the scrambler 26 are fed to a further inverter 28 which is identical to inverter 24. This inverter can be switched in or out to further increase the number of system codes. With two inverters, four distinct scrambling codes are available for each value of k, assuming that the sampling rate is maintained constant. The output of the inverter 28 is fed to a digital-to-analogue converter 30 (including an interpolation filter) operable at the same rate as converter 22. Instead of varying the sampling rate, the value of N used by the scrambler may be varied. The output of the digital to analogue converter 30 is fed along the telephone line 32.

At the receiving end of the telephone line 32 the signal is input to a de-scrambling system consisting of an analogue-to-digital converter 34 which supplies samples to an inverter 36 which is followed by a de-scrambler 38 which is identical to the scrambler described with reference to FIG. 1 with a key k* where $k\,k^* \pmod N = 1$. The output from the scrambler 38 is fed via inverter 40 to a digital-to-analogue converter 42 the output of which is applied to a suitable electro-acoustic transducer such as an ear piece of a telephone receiver.

The scrambling and de-scrambling systems may be set so that during a single telephone conversation, the code represented by the states of the inverter, key k and sampling rate or value of N are maintained constant. At the de-scrambler the states of the inverter and sampling rate are the same as in the scrambler and the scrambler key k* is chosen such that $k\,k^* \pmod N = 1$.

In a variant system the code may be changed periodically. This may be done by varying the setting of the inverters, the sampling rate or the key k independently or varying some or all of these factors. If such a rolling code is used then it is necessary for there to be some form of synchronisation between the scrambling and de-scrambling systems. However, since a code need only be changed relatively infrequently the requirement for synchronisation is much less rigorous than for prior art time-domain block scramblers which must be precisely synchronised. A brief resynchronisation period of the scrambler will not unduly adversely affect the transmitted signal since a voice signal is generally intelligible even if it is corrupted for short periods.

Certain of the values of k produce very similar scrambling effects so that if a signal is scrambled with one key and descrambled with the other key, an intelligible signal is produced even though it is considerably distorted. This arises where $k_1$ and $k_2$ have the relationship that $k_2^*\,k_1 = (N-1) \pmod N$. This has the result that band r is transposed to band $N-r$. Since the frequency spectrum is symmetric because all the samples are real, the spectrum of the de-scrambled signal is very similar in form to the unscrambled signal although each band has been inverted about its centre frequency. Accordingly, such keys should not be used consecutively in a rolling code system.

Another relationship between $k_1$ and $k_2$ which produces an intelligible signal when de-scrambled with the wrong key arises when $k_2 * k_1 \pmod N = 2$. Thus in any rolling code system such pairs of k should not be used in sequence. Other relations between $k_1$ and $k_2$ which exhibit the same difficulty may exist.

In a further embodiment of the scrambling system, a cyclic shifting process may be made on frequency components in the range $0<f<\frac{1}{2}$. The frequency components in the range $-\frac{1}{2}<f<0$ are similarly shifted such that the time domain samples remain real. A frequency shift which operates on an analogue signal is described in an article entitled "MISTIC, an analogue speech scrambler" by R. Nettleship published in Phillip Telecom Review, vol.41, No.1, April 1983.

An alternative technique for scrambling, incorporating this cyclic frequency shift, is a process which will be referred to herein as single side band (ssb) scrambling. The spectrum of the voice signal is first shifted such that the negative band of frequencies $-\frac{1}{2}<f<0$ moves to $-\frac{1}{4}<f<\frac{1}{4}$. This is done by multiplying the time samples of the input voice signal by a suitable exponential function. The shifted band of the frequency spectrum corresponding to frequency components originally in the range $0<f<\frac{1}{2}$ is then removed using a low pass filter passing only frequencies $|f|<\frac{1}{4}$. A suitable low pass filter for this purpose is $$h_1(n) = w(n)\mathrm{sinc}(\pi n/2) \quad |n| < K \qquad (9)$$
$$= 0 \text{ otherwise}$$

This filter function also has the useful property that for even values of n (except zero), it is equal to zero. w(n) is a suitable window function and K is an integer where K=5 is a typical example. The effect of the shifting and filtering processes is to reduce the bandwidth of the voice signal by half, although the resulting signal samples are complex. However, this does not change the overall memory requirement as all the odd time samples are zero. The equations for the combined shifting and filtering operation are to form an ssb signal are:

$$Re[x''(2r)] = x(2r)(-1)^r h(0)$$
$$Im[x''(2r)] = \sum_{r'} x(2r - 2r' - 1)(-1)^{r-r'} h(2r' + 1)$$

where the limits of summation are $-K<2r'+1<K$, and the sequence of ssb samples is x'' (2r). A cyclic frequency shift on components in the range $-\frac{1}{4}\leqq f\leqq\frac{1}{4}$, similar to that performed in MISTIC, can be obtained easily by multiplying the ssb samples by exp ($j4\pi(pr)$ where $0<p<\frac{1}{2}$. The modified sequence of ssb samples is fed to the scrambler which is identical to that described with reference to FIG. 1. The main scrambling is unchanged except that it is performed with even samples only since the remaining samples are zero.

In order to produce a real time signal from the output samples, it can be shown that:

$$y(2r) = (-1)^r Re\,[y''(2r)]h(0) \qquad (10)$$
$$y(2r + 1) = (-1)^r \sum_{r'} Im[y''(2r - 2r')]h(2r' + 1)$$

where the limits of the summation are $-K<2r'+1<K$

Cyclic frequency shifting performed by either of the above defined processes may be used both before and after the scrambling. This may give a useful improvement in security, possibly subject to some constraints.

I claim:

1. A speech scrambler having an input for an analogue speech signal and an output for a scrambled analogue signal, said scrambler including an analogue-to-digital converter having an input connected to said scrambler input and an output which is a series of digital time samples produced at regularly spaced time intervals, which represent the input speech signal, storage means having an input connected to said output of said analogue-to-digital converter and operative to store a predetermined number of the most recently produced time samples, selecting means operatively connected to said storage means to select some of said stored samples in accordance with a down sampling function, said selection being carried out at said regularly spaced time intervals, multiplying means operatively connected to said selecting means to multiply each selected sample by a predetermined factor, each said multiplying means having an output for the product of said sample and said factor, summing means having a plurality of inputs, each connected to one said output of a respective one of said multiplying means, said summing means having an output, which, after each said time interval, is operative to produce a digital representation of the sum of said products, and a digital-to-analogue converter having an input connected to said output of said summing means, and an output connected to said scrambler output, and which is operative to convert the series of digital representations from said summing means into said scrambled analogue signal.

2. A speech de-scrambler for use in conjunction with the scrambler according to claim 1, wherein the de-scrambler is a scrambler according to claim 1 operating on said scrambled analogue signal instead of said input speech signal, and in which said down-sampling function of said selecting means has the inverse effect to said down-sampling function of said selecting means in the scrambler.

3. A speech scrambler, including an analogue-to-digital converter having an input for an input speech signal and an output, and which is operative to produce a series of time samples x(n) at said output, means having an input and an output, said input being operatively connected to said output of said converter to derive a further series y(n) of time samples at said output from the x(n) in accordance with the following equation:

$$y(n) = \sum_{n'=1}^{2LN} x(n - n')\, h(n')\, s(n' + n(k - 1))$$

where h(n') is a windowing function, and $$s(n) = 1 \quad n = \ldots -N, 0, N, 2N \ldots$$
$$= 0 \text{ otherwise}$$

N is a constant of the system, k is a key selected from the range $2\leqq k\leqq N-1$ and k and N are coprime, and digital-to-analogue converting means having an input connected to said output of said deriving means and an output and which is operative to convert said further series of samples y(n) into a scrambled output signal at said output.

4. A de-scrambler for use in conjunction with the scrambler according to claim 1, in which the de-scrambler includes a scrambler according to claim 1 which uses a key k*, where $k^*.k=1$ (mod N) in said deriving means.

5. A communications system including two scramblers according to claim 3, in which one of said scramblers is operative as a de-scrambler, and a telephone line connecting said output of said scrambler to said input of said de-scrambler, said key k of said deriving means of said scrambler and said key k* of said deriving means of said de-scrambler being such that $k^*.k=1$ (mod N), the system further including a pre-emphasis filter connected between said input to said scrambler and said analogue-to-digital converter, and a de-emphasis filter connected to said output of said digital-to-analogue converter of said de-scrambler.

6. A system according to claim 5, in which at least one selectively operable inverter is connected either after said analogue-to-digital converter and/or before said digital-to-analogue converter in both said scrambler and said de-scrambler.

7. A system according to claim 5, further including means for varying in time a code of said system, which code includes said key k of the scrambler and said key k* of said de-scrambler and means for synchronising changes in the codes of the scrambler and de-scrambler.

8. A system according to claim 7, in which the code further includes the value of N or the sampling rates of said converters.

9. A method of speech scrambling and descrambling without requiring synchronisation between a scrambler and a descrambler, comprising the steps of operating only on time samples of an input speech signal in such a way as to effect permuting of the sub-bands of a frequency spectrum of the input speech signal to produce an output frequency spectrum of a scrambled signal, the permutation being such that the r th sub-band of said spectrum of said input speech signal is shifted to the k.r th sub-band of the scrambled signal where k is a key, and $2 \leqq k \leqq N-1$, where N is the number of sub-bands and k and N are coprime, and descrambling the scrambled signal by operating only on time samples of the received scrambled signal in a corresponding manner to the scrambling operation using a key k* where $kk^*=1$ (Mod N).

* * * * *